US006381407B2

(12) United States Patent
Choi

(10) Patent No.: US 6,381,407 B2
(45) Date of Patent: Apr. 30, 2002

(54) LAMP HEAT GENERATING APPARATUS

(76) Inventor: Jong Kuk Choi, Suit 102, Wonjong green village, Wonjong-dong 364-4, Ohjung-ku, Puchon-city, Kyonggi-do (KR)

( * ) Notice: Subject to any disclaimer, the term of this patent is extended or adjusted under 35 U.S.C. 154(b) by 0 days.

(21) Appl. No.: 09/796,062

(22) Filed: Feb. 27, 2001

(30) Foreign Application Priority Data

Mar. 3, 2000 (KR) ..... 00-5888

(51) Int. Cl.[7] ..... F24H 3/00; F24D 13/00
(52) U.S. Cl. ..... 392/376; 392/365
(58) Field of Search ..... 392/365, 376, 392/410, 375, 377

(56) References Cited

U.S. PATENT DOCUMENTS

| | | | | | |
|---|---|---|---|---|---|
| 939,106 | A | * | 11/1909 | Soles | 392/376 |
| 1,006,767 | A | * | 10/1911 | Mauger | 392/385 |
| 1,383,564 | A | * | 7/1921 | Phillipson | 392/376 |
| 1,674,017 | A | * | 6/1928 | Marsden | 392/365 |
| 1,961,772 | A | * | 6/1934 | Martin | 392/365 |
| 2,041,897 | A | * | 5/1936 | Benson | 392/375 |
| 3,792,230 | A | * | 2/1974 | Ray | 392/385 |
| 3,864,547 | A | * | 2/1975 | Ray | 392/385 |
| 4,835,367 | A | | 5/1989 | Hoffman | |
| 5,778,144 | A | | 7/1998 | McDougall | 392/385 |
| 5,793,019 | A | * | 8/1998 | Boyle et al. | 392/376 |
| 6,205,677 | B1 | * | 3/2001 | Yune | 34/266 |

FOREIGN PATENT DOCUMENTS

| | | | | |
|---|---|---|---|---|
| GB | 757935 | * | 9/1956 | 392/375 |
| JP | 53-93646 | * | 8/1978 | 392/365 |
| JP | 10-325609 | * | 12/1998 | |
| WO | 00/00055 | * | 1/2000 | |

* cited by examiner

*Primary Examiner*—John A. Jeffery
(74) *Attorney, Agent, or Firm*—Lee & Hong

(57) ABSTRACT

The present invention relates to a heat generating apparatus for a heater, and an object thereof is to provide the heat generating apparatus, which the durability of a heating element and a heating operation/effect are highly increased, and also the convenience of user is improved. The present invention uses a detachable halogen-heating lamp as a heating element, and reflects a high temperature light forwardly by the reflecting mirror and at the same time sends a heated air around the halogen-heating lamp forwardly by a fan to perform the heating operation. Therefore, the present invention obtains double heating effect by the reflected heat and heated air, increases a durability and heating effect of the heater, and improves the convenience is use of the heater.

4 Claims, 6 Drawing Sheets

LAMP HEAT GENERATING APPARATUS

BACKGROUND OF THE INVENTION

1. Field of the Invention

The present invention relates to a heater, more specifically a heat generating apparatus for the heater, which is suitable for a small heater and could maximize a heating effect.

2. Background of the Related Art

Various types of a heater exist, and among them a heater using electricity('an electric heater') converts electric energy into heat energy by means of a resistance element and performs a heating operation using this heat energy. The electric heater reflects the heat generated in the resistance element to be spread forwardly using a reflection plate, or blows the heat generated in the resistance element forwardly using a fan.

As the electric heater mentioned above does not contaminate an air or a floor of a room nearly, it is used widely for the place that is relatively small and requires a fresh air and a clean floor.

However, since the conventional electric heater mentioned above performs the heating using the reflection plate or the fan, the heating efficiency and the heating effect are not good enough.

To solve this problem, the electric heater using both the reflection plate and the fan is contemplated, and this electric heater has better heating operation and efficiency than those of the mentioned above. However, since the electric heater uses a filament made of an ally of Fe, Cr and Ni as a heating element, the oxidization of the heating element is facilitated by the direct contact of air so that its durability is decreased, and the heating element is exposed by the oxidization so the a fire could be occurred and a good heat emission is not exhibited. Additionally, if the heating element is damaged its exchange is difficult.

SUMMARY OF THE INVENTION

The present invention is contemplated to solve the aforementioned problem, and it is an object of the present invention to provide heat generating apparatus for heater, which uses a halogen-heating lamp having a good durability and heating effect as a element for generating heat, reflects a high temperature light forwardly by a reflecting mirror and sends the heated air forwardly by the blown air by a fan, so that a durability of the heater is increased and the heating operation and effect is highly improved.

To accomplish the above object, it is provided a heater comprising: a cover plate being a hemispherical plate and formed with a vent hole in a center potion thereof; a safety cover combined in front of the cover plate; a reflecting mirror being a hemispherical plate having a good reflexibility and formed with the vent hole in a center portion thereof, the reflecting mirror fixed to an inside of the cover plate to maintain a constant distance to the cover plate; a rear cap combined in rear of the cover plate; a fan operated by a motor and installed within the rear cap; and a heat generating apparatus including: an air guide plate being a plate and fixed in front of the vent hole of the reflecting mirror to maintain a predetermined distance thereof, an isolation block having a connection terminal and a lamp connecting groove, the isolation block fixed to a front surface of the air guide plate, a halogen-heating lamp having a body of a quartz pipe member in a shape of '∩' accommodating a heating element, the heating element being connected to a connection pin extending from the end portion of the pipe member, and a holding block for holding an end portion of the body, wherein as the holding block is inserted in the connection groove of the isolation block, the connection pin is inserted in the connection terminal of the isolation block simultaneously.

In the heat generating apparatus for heater, a high temperature light from the halogen-heating lamp is reflected forwardly and a heated air around the halogen-heating lamp moves forwardly by the blown air through an air path formed between the vent hole and the air guide plate, so that the heating operation is performed.

Also, the present invention obtains a good heating effect by omitting the fan and disposing only the halogen-heating lamps appropriately.

BRIEF DESCRIPTION OF THE DRAWINGS

The features and advantages of the present invention will be more described specifically in the following description of preferred embodiments of the invention with reference to the accompanying drawings wherein.

DETAILED DESCRIPTION OF THE PREFERRED EMBODIMENT

Figure 1:
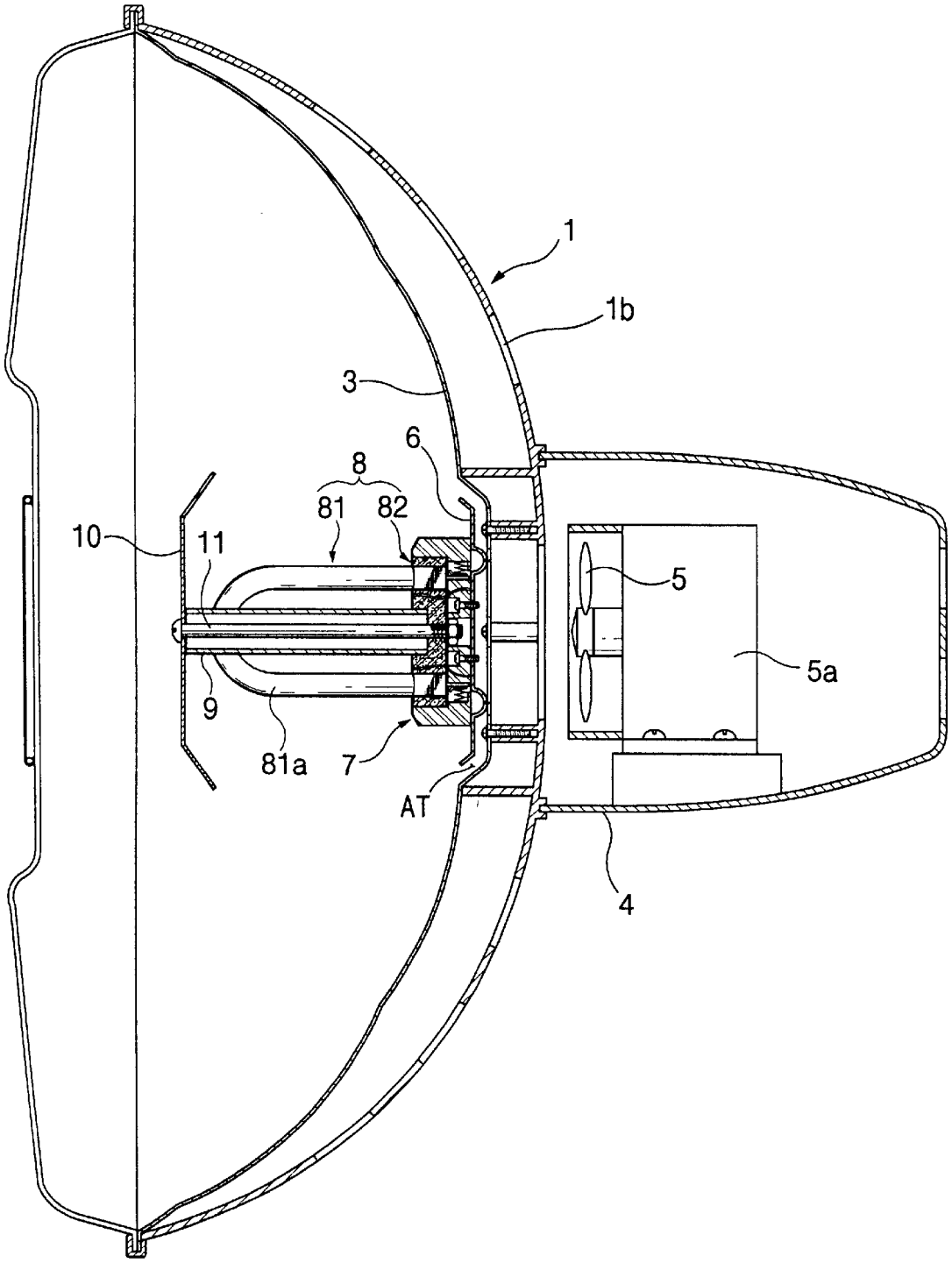
FIG. 1 is a sectional view of a heat generating apparatus for heater according to the first embodiment of the present invention.

Reference will now be made in detail to the embodiment of the present invention and examples of which are illustrated in the accompanying drawings. In explaining the present invention, the same names and reference numerals will be given to the same components, and explanations in the same will be omitted.

Figure 2:
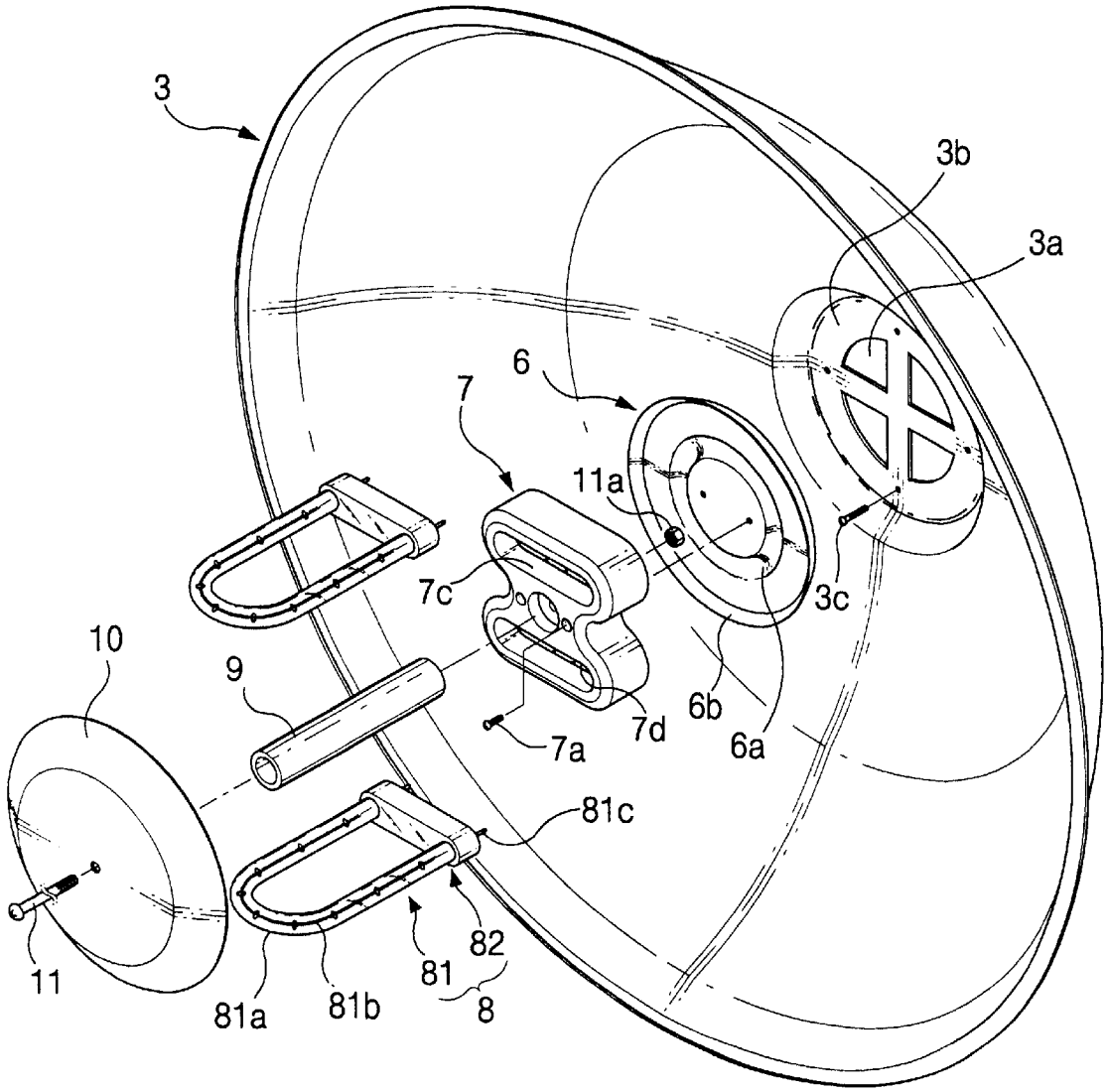
FIG. 2 is an exploded perspective view of an essential part in the heat generating apparatus for heat according to the first embodiment of the present invention.
Figure 3:
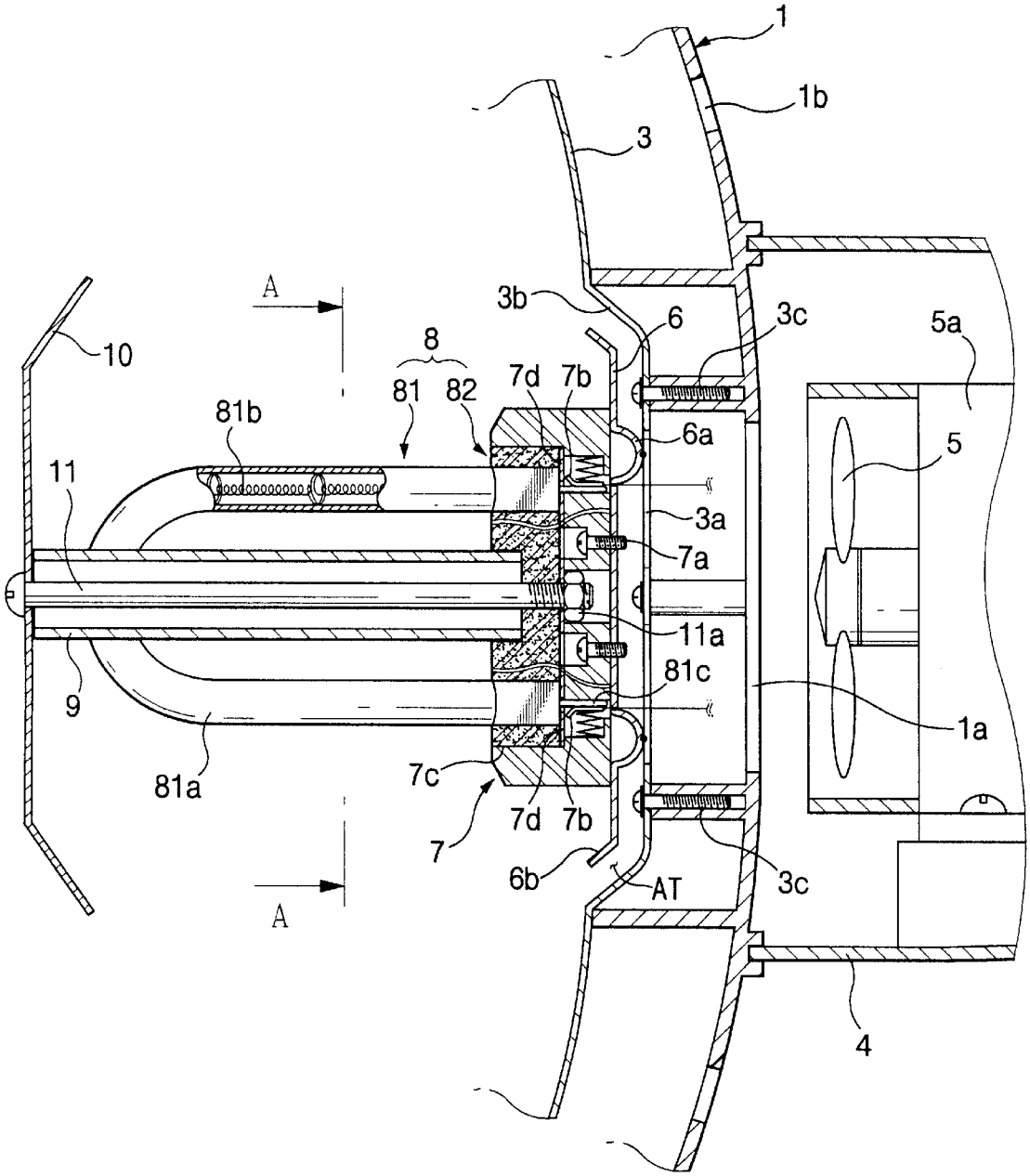
FIG. 3 is an enlarged sectional view of an essential part in the heat generating apparatus for heat according to the first embodiment of the present invention.
Figure 4:
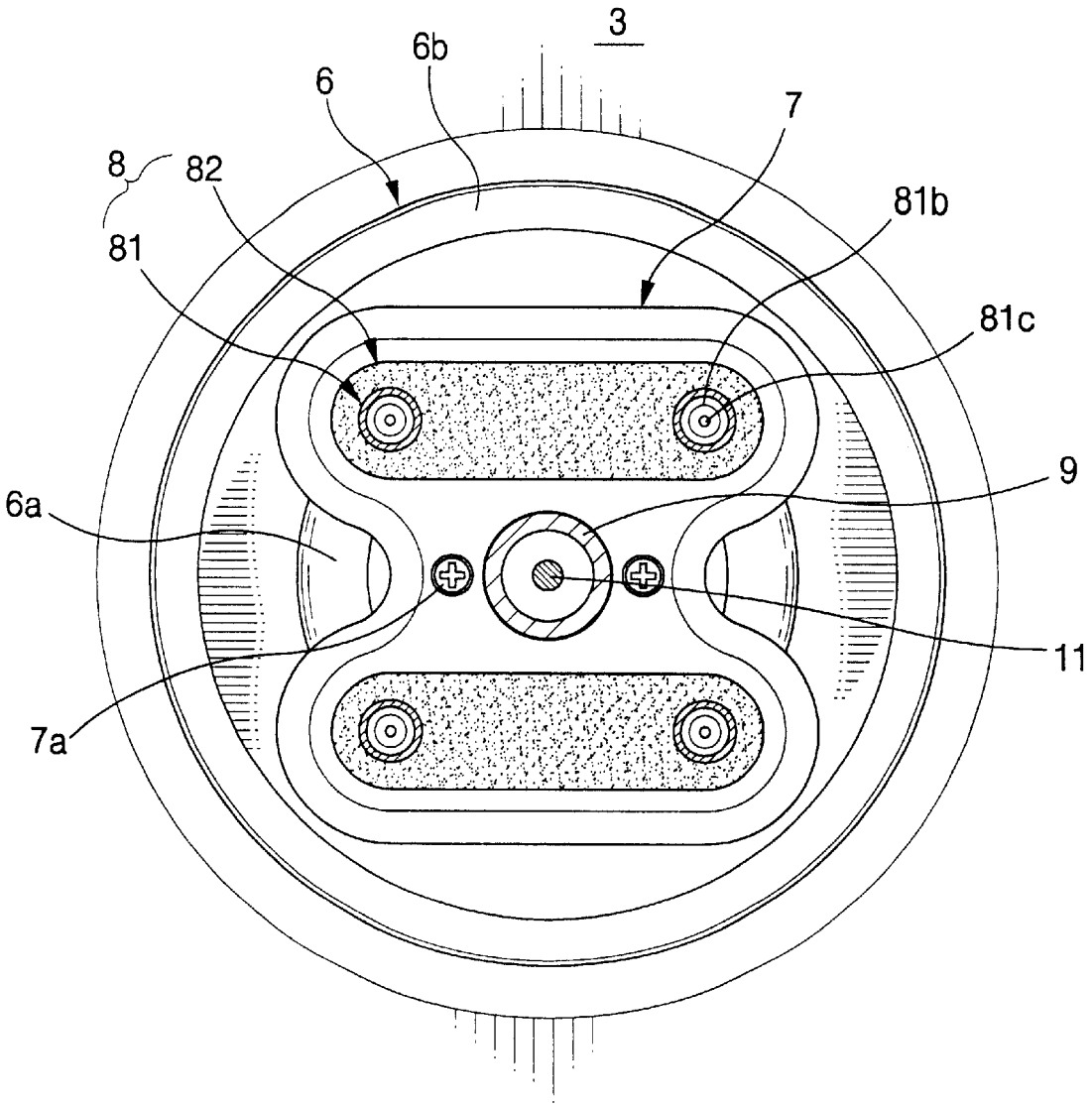
FIG. 4 is a sectional view taken along a—a line in FIG. 3.

FIG. 1 illustrates a sectional view of a heat generating apparatus for heater according to the first embodiment of the present invention, FIG. 2 illustrates an exploded perspective view of an essential part in the heat generating apparatus for heat according to the first embodiment of the present invention, and FIG. 3 is an enlarged sectional view of an essential part in the heat generating apparatus for heat according to the first embodiment of the present invention.

A cover plate 1 is a hemispherical plate entirely, and is formed with a vent hole 1*a* in a center potion thereof. And, in the entire surface of the cover plate 1, a radiation hole 1*b* is formed to radiate a heat produced in the cover plate 1.

In front of the cover plate 1, combined is a safety cover 2 for preventing the inflammables or the human body from contacting with a halogen-heating lamp 8 which will be described below.

A reflecting mirror 3 for reflecting a light emitted from the halogen-heating lamp 8 is disposed within the cover plate 1.

The reflecting mirror 3 is also a hemispherical plate of which an inner surface is coated with an aluminum having a good reflexibility, and is formed with a vent hole 3*a* in a center portion thereof. And, an inclined surface 3*b* is formed in an outer circumference adjacent to the vent hole 3*a*. This reflecting mirror 3 is fixed to an inside of the cover plate 1 by means of a fastening member 3*c*, maintaining a constant distance to the cover plate 1.

In rear of the cover plate 1, combined is a rear cap 4 having a plurality of vent holes 4*a*.

A fan 5 operated by a motor 5*a* is installed within the rear cap 4 to blow an air toward the vent hole 1*a* of the cover plate.

In front of the vent hole 3*a* of the reflecting mirror 3, disposed is an air guide plate 6 for guiding an air passing the vent holes 1*a*, 3*a* of the cover plate 1 and the reflecting mirror 3 toward through an inner space of the reflecting mirror 3.

The air guide plate 6 is a plate having a rear projecting part 6*a* and is formed with a guide blade 6*b* inclined forward on an outer circumferential end thereof so that the projecting part 6*a* is fixed on a central inner surface of the reflecting mirror 3 by a spot welding.

Due the fixation of the air guide plate 6 mentioned above, an air path AT is formed between the air guide plate 6 and the vent hole 3*a* of the reflecting mirror 3, so that through the air path AT, an air from the fan 5 proceeds forwardly through the inner space of the reflecting mirror 3.

An isolation block 7 is fixed to a front surface of the air guide plate 6 by means of a fastening member 7*a*.

The isolation block 7 is provided with two pairs of connection terminal 7*b* to couple a connection pin therein, is formed with a pair of lamp connecting groove 7*c*, and is coupled with a cover plate 7*d* at a bottom of the lamp connecting groove 7*c*. a lead for supplying an electricity is connected to the connection terminal 7*b*.

A pair of the halogen-heating lamp 8 is inserted in the isolation block 7.

The halogen-heating lamp 8 comprises a body 81 for generating a heat and a holding block 82 for holding an end portion of the body 81. The body 81 has a shape of '∩', a tungsten heating element 81*b* is accommodated in a quartz pipe member 81*a*, and the heating element 81*b* is connected to the connection pin 81*c* extending from the end portion of the pipe member 81*a*. The holding block 82 is formed by a ceramic molding so as to wrap and connect both ends of the pipe member 81*a*. Due to the holding block 82, in handling the halogen-heating lamp 8, the breakage of the pipe member 81*a* by the external force is prevented.

In the halogen-heating lamp 8, as the holding block 82 is inserted in the connection groove 7*c* of the isolation block 7, the connection pin 81*c* is inserted in the connection terminal 7*b* of the isolation block 7 simultaneously.

In the first embodiment, especially the adaptation of the halogen-heating lamp 8 detachable to the isolation block 7 for generating a heat is to exchange the halogen-heating lamp 8 easily and to obtain a good heating effect.

In the halogen-heating lamp 8, a stay 9 of a hollow shaft is disposed centrally in front of the holding block 82, and a reflecting plate 10 for reflecting a heat and light from the halogen-heating lamp 8 is adhered closely to a front end of the stay 9. And, these stay 9 and reflecting plate 10 is fixed to the holding block 82 by means of a bolt 11 passing through the stay 9 axially and a nut 11 a fastened to an end portion of the bolt 11, which penetrates the holding block 82 and the cover plate 7*d* of the isolation block 7. The reflecting plate 10 could be fixed to a central inside of the safety cover 2.

In the first embodiment, the rear cap 4 is coupled with a stand(not shown) so that the heater could be used standing on the floor and the rear cap 4 is also coupled with rotating means so that the heater could be used fixed on the ceiling. These stand and rotating means is the same as those of a conventional electric fan.

The heating operation using the apparatus for heater of the first embodiment is as follows.

As the electricity is supplied to the motor 51 and halogen-heating lamp 8, the body 81 of the halogen-heating lamp 8 generates a heat and light of a high temperature, and the fan 5 blows an air into the inner space of the reflecting mirror 3 through the vent holes 1*a*, 3*a* of the cover plate 1 and reflecting mirror 3 and the air path AT.

As the body 81 generates a heat and light of a high temperature and an air is forwarded by the fan 5 through the inner space of the reflecting mirror 3, the light from the body 81 is reflected forwardly by the reflecting mirror and a heated air around the halogen-heating lamp 8 moves forwardly with the air sent by the fan 5. The light reflected forwardly from the body 81 is reflected toward the reflecting mirror 3 by the reflecting plate 10, and then reflected uniformly again.

Therefore, the heat generating apparatus of the first embodiment performs the heating operation by both the reflection of the high temperature light generated from the halogen-heating lamp 8 and the forwarding of the heated air around the halogen-heating lamp 8 at the same time.

Meanwhile, when the heat-generating lamp does not perform well during the use of the heat generating apparatus, the halogen-heating lamp is pulled out to be separated from the isolation block 7 and is exchanged for new one. In this case, the end portion of the body 81 is held by the holding block 82, the pipe member is not broke by the external force in the exchange.

Additionally, in the first embodiment, if the pipe member 81*a* of the halogen-heating lamp 8 is coated with a bio-ceramic material, infrared rays emitted from the bio-ceramics is irradiated to the nearby human body so that the improvement in health could be achieved.

Figure 5:
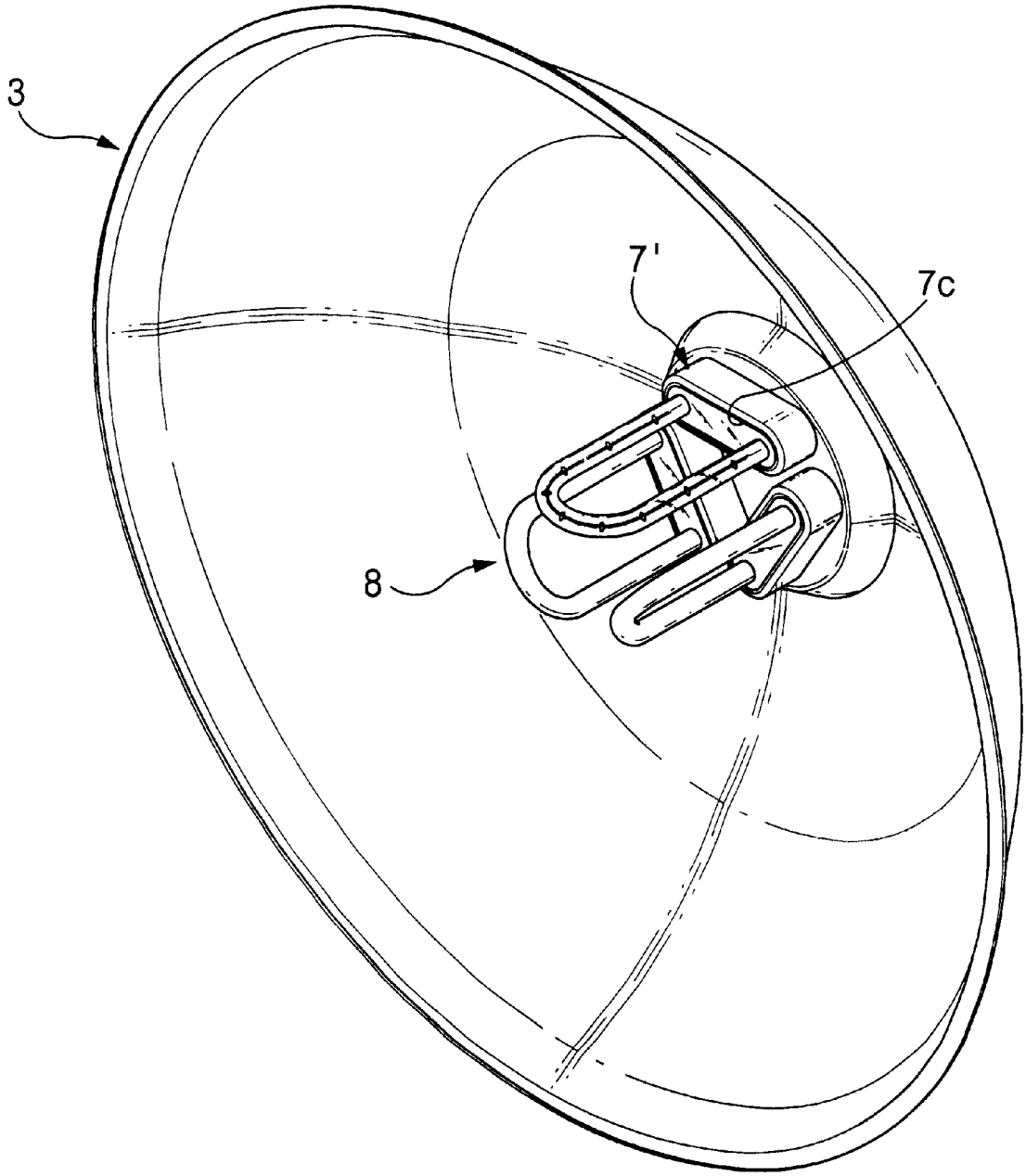
FIG. 5 is a perspective view of the heat generating apparatus for heater according to the second embodiment of the present invention.

FIG. 5 illustrates a perspective view of the heat generating apparatus for heater according to the second embodiment of the present invention; and In the second embodiment, the vent hole 3*a* formed in the center of the reflecting mirror 3 and the air guide plate 6 of the fan 5 in the first embodiment are omitted, and the shape of the isolation block 7 is changed.

The isolation block 7' in the second embodiment is formed with only one connection groove 7*c*. And, these isolation blocks 7' are disposed and fixed to form a triangle and equal to the first embodiment, the halogen-heating lamp 8 is inserted in the connection groove 7*c* of the isolation block 7'.

In the second embodiment, while the heating operation by the fan does not exist a good heating effect is provided, with only the halogen-heating lamps 8 disposed appropriately.

The above merely discloses the preferred embodiments of the present invention, and does not limit the spirit of the present invention.

Figure 6:
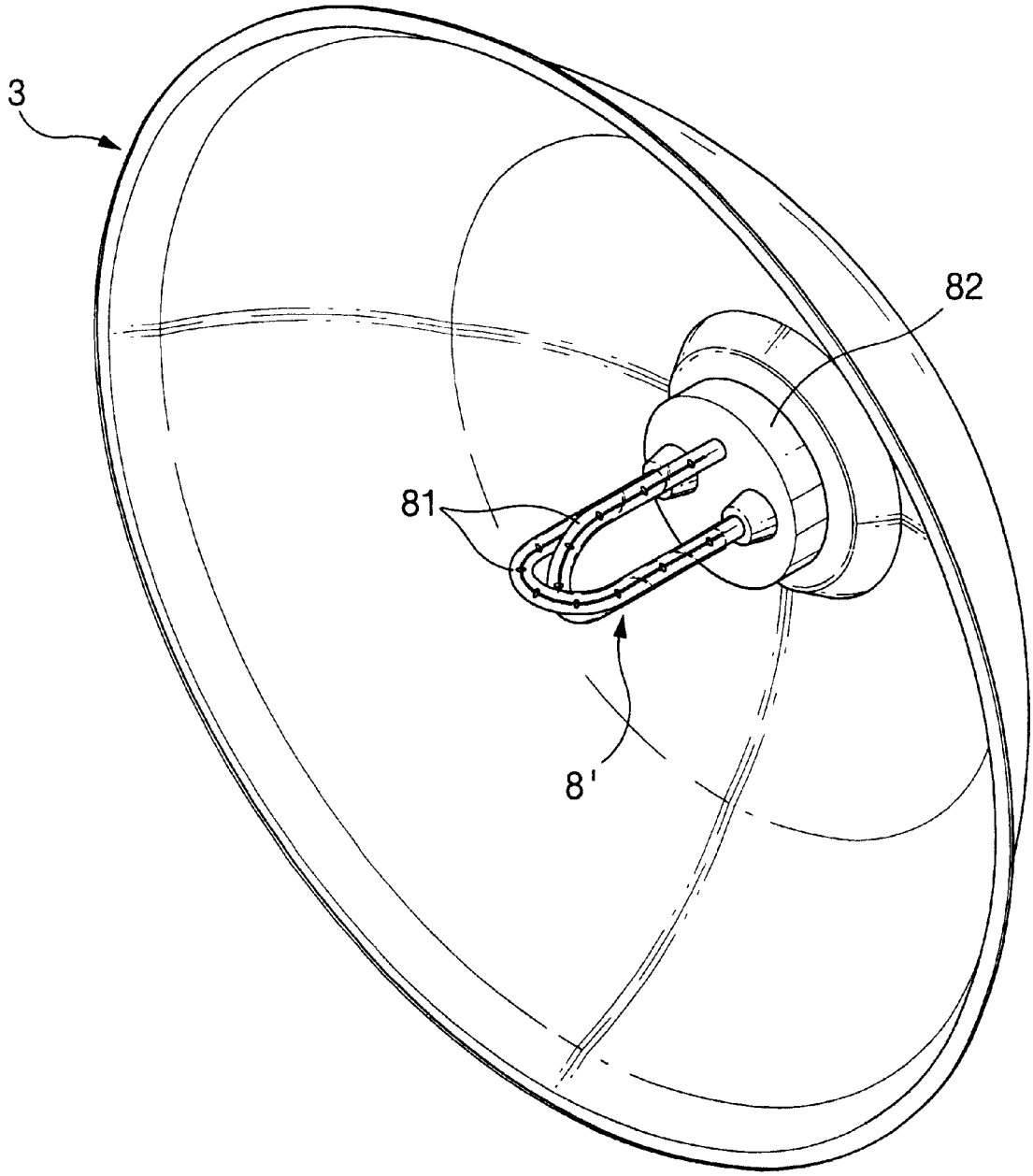
FIG. 6 is a perspective view showing a modification of the heat generating apparatus for heater according the present invention.

For example, as shown in FIG. 6, it is possible to omit the isolation block 7, have two body 81 of the halogen-heating lamp 8' to be crossed, hold the end portion there of with the circular holding block 82, and have the holding block 82 of the halogen-heating lamp 8' to be fixed to the center of the reflecting mirror 3 directly. It is apparent that these modification fall into the scope of the present invention.

The effects of the present invention could be summarized as follows.

In the heat generating apparatus for the heater, since the high temperature light is reflected forwardly by the reflecting mirror and the heated air around the halogen-heating lamp move forwardly by the blown air through the air path between the vent hole of the reflecting mirror and the air guide plate for performing the heating operation, double heating effect by the reflected heat and heated air could be obtained.

In addition, the present invention uses the halogen-heating lamp having a good durability and heating effect as a medium for generating heat and permits the halogen-heating lamp to be changed easily. Therefore, a durability and heating effect of the heater is increased highly, and the convenience in using the heater is improved. Also, as the heating element is not exposed, the present invention reduces the danger of the fire. Furthermore, if the fan is not in use, the present invention provides a good heating operation by arranging the halogen-heating lamps suitably.

It will be apparent to those skilled in the art that various modifications and variations can be made in the fin tube type evaporator in an air conditioner of the present invention without departing from the spirit or scope of the invention. Thus, it is intended that the present invention cover the modifications and variations of this invention provided they come within the scope of the appended claims and their equivalents.

What is claimed is:

1. A heater comprising:

a cover plate being a hemispherical plate and formed with a vent hole in a center portion thereof;

a safety cover combined in front of the cover plate;

a reflecting mirror comprising a hemispherical plate having a good reflexibility and formed with the vent hole in a center portion thereof, the reflecting mirror fixed to an inside of the cover plate to maintain a constant distance to the cover plate;

a rear cap disposed on rear of the cover plate;

a fan operated by a motor and installed within the rear cap; and a heat generating apparatus including:

an air guide plate fixed in front of the vent hole of the reflecting mirror to maintain a predetermined distance thereof, an isolation block having a connection terminal and a lamp connecting groove, the isolation block fixed to a front surface of the air guide plate, a halogen-heating lamp having a body of a quartz pipe member in a shape of '∩' accommodating a heating element, the heating element being connected to a connection pin extending from the end portion of the pipe member, and a holding block for holding an end portion of the body, wherein as the holding block is inserted in the connection groove of the isolation block, the connection pin is inserted in the connection terminal of the isolation block simultaneously;

wherein high temperature light from the halogen-heating lamp is reflected forwardly and heated air around the halogen-heating lamp moves forwardly by the blown air through an air path formed between the vent hole and the air guide plate so that the heating operation is performed.

2. A heater according to claim 1, wherein a reflecting plate for reflecting the heat and light from the halogen-heating lamp to the reflecting mirror is located in front of the halogen-heating lamp.

3. A heater according to claim 1, wherein the vent hole formed in the center of the reflecting mirror, the air guide plate and the fan are omitted, a plurality of isolation blocks, each block is formed with only one connection groove, each isolation block is disposed and fixed to form a triangle, and the halogen-heating lamp is inserted in the connection groove of the isolation block.

4. A heater according to claim 3, wherein the isolation block is omitted, two halogen-heating lamps mounted such that said lamps cross each other, the end portions thereof are held with a circular holding block, the holding blocks are fixed to the center of the reflecting mirror directly.

* * * * *